US011346152B2

(12) United States Patent
Wong

(10) Patent No.: US 11,346,152 B2
(45) Date of Patent: May 31, 2022

(54) CURTAIN ASSEMBLY AND INSTALLATION METHODS THEREOF

(71) Applicant: Film Technology Industrial Limited, Hong Kong (CN)

(72) Inventor: Chi Keung Wong, Hong Kong (CN)

(73) Assignee: Film Technology Industrial Limited, Kowloon (CN)

( * ) Notice: Subject to any disclaimer, the term of this patent is extended or adjusted under 35 U.S.C. 154(b) by 759 days.

(21) Appl. No.: 16/213,311

(22) Filed: Dec. 7, 2018

(65) Prior Publication Data

US 2019/0269269 A1 Sep. 5, 2019

(30) Foreign Application Priority Data

Mar. 1, 2018 (CN) ..... 201810172060.X

(51) Int. Cl.
*E06B 9/36* (2006.01)
*A47H 13/04* (2006.01)
*A47H 23/10* (2006.01)

(52) U.S. Cl.
CPC ..... *E06B 9/367* (2013.01); *A47H 13/04* (2013.01); *A47H 23/10* (2013.01)

(58) Field of Classification Search
CPC ..... A47H 13/01; A47H 13/04; A47H 23/01; A47H 23/02; A47H 23/10; E06B 9/36; E06B 9/362; E06B 9/365; E06B 9/367
See application file for complete search history.

(56) References Cited

U.S. PATENT DOCUMENTS 1,554,863 A * 9/1925 Machowicz ..... A47H 5/032 160/126
1,841,065 A * 1/1932 Simon ..... E06B 9/362 160/172 R
2,158,454 A * 5/1939 Zubiria ..... E06B 9/367 160/172 V
2,188,575 A * 1/1940 McLennan ..... E06B 9/36 160/118
2,207,420 A * 7/1940 Thomas ..... E06B 9/36 160/121.1
2,604,159 A * 7/1952 Wright ..... E06B 9/367 160/172 R
2,728,389 A * 12/1955 Simon ..... E06B 9/36 160/199
4,291,738 A * 9/1981 Grenga ..... E06B 9/367 160/176.1 R
4,434,834 A * 3/1984 Ennes ..... E06B 9/386 160/166.1

(Continued)

*Primary Examiner* — Johnnie A. Shablack
(74) *Attorney, Agent, or Firm* — Leydig, Voit & Mayer, Ltd.; John Augustyn

(57) ABSTRACT

A curtain assembly includes a curtain lamina made of a multifunctional multilayer composite sheet material, a top retaining member disposed on top of the curtain lamina and configured to receive the curtain lamina and to suspend the curtain lamina onto a curtain rail, and a counterweight portion disposed at a bottom of the curtain lamina and configured to receive the curtain lamina and stabilize the curtain lamina. The top retaining member includes a first holding piece, a second holding piece, a top fastener, and a top fixing device. The counterweight portion includes a first vertical weight piece, a second vertical weight piece, a bottom fastener, and a bottom fixing device.

13 Claims, 5 Drawing Sheets

(56) References Cited

U.S. PATENT DOCUMENTS 4,519,435 A * 5/1985 Stier ..... E06B 9/386 160/168.1 V
4,529,025 A * 7/1985 Oskam ..... E06B 9/367 160/178.1 V
4,597,429 A * 7/1986 Driessen ..... E06B 9/367 160/236
5,111,868 A * 5/1992 Sawaya ..... A47H 13/01 16/87.2
5,123,471 A * 6/1992 Ford ..... E06B 9/367 160/168.1 V
5,143,136 A * 9/1992 John ..... E06B 9/367 160/173 R
5,168,913 A * 12/1992 Haines ..... E06B 9/362 160/168.1 R
5,271,447 A * 12/1993 Aronovich ..... E06B 9/386 160/236
5,458,939 A * 10/1995 Kitchen ..... B29C 73/04 160/178.1 R
5,601,132 A * 2/1997 Goodman ..... E06B 9/36 160/173 V
6,050,322 A * 4/2000 Finkelstein ..... A47H 1/04 160/178.1 R
6,289,563 B1 * 9/2001 Watkins ..... E06B 9/367 160/178.1 V
6,561,251 B1 * 5/2003 Prosch ..... E06B 9/36 160/115
6,945,304 B1 * 9/2005 Kleynjans ..... E06B 3/80 160/184
10,934,770 B2 * 3/2021 Badenhorst ..... E06B 9/364
2004/0163295 A1 * 8/2004 Fontana ..... G09F 15/0018 40/617
2006/0196617 A1 * 9/2006 Barkman ..... E06B 9/386 160/236
2006/0278350 A1 * 12/2006 Zamarripa ..... E06B 9/367 160/178.1 V
2007/0215200 A1 * 9/2007 Lim ..... E06B 9/386 136/246
2007/0267153 A1 * 11/2007 Hardy ..... E06B 9/367 160/168.1 V
2007/0284059 A1 * 12/2007 Chen ..... E06B 9/36 160/168.1 V
2008/0236766 A1 * 10/2008 Vandervoort ..... B29C 66/7485 160/172 V
2017/0137262 A1 * 5/2017 Miller ..... A47H 1/18
2017/0354285 A1 * 12/2017 Kim ..... A47H 23/05

* cited by examiner

CURTAIN ASSEMBLY AND INSTALLATION METHODS THEREOF

RELATED APPLICATIONS

This application claims priority to the Chinese Patent Application No. 201810172060.X filed on 1 Mar. 2018 and entitled "MULTIFUNCTIONAL MULTILAYER COMPOSITE SHEET MATERIAL VERTICAL CURTAIN ASSEMBLY AND INSTALLATION METHODS THEREOF", the entire contents of which are hereby incorporated by reference.

FIELD OF THE INVENTION

The invention relates to curtain, and in particular to curtain assembly and installation methods thereof.

BACKGROUND

Multifunctional multilayer composite sheet materials can block the solar radiation heat from entering into the room, prevent the room temperature from rising, and achieve the energy-saving benefit. They can also provide indoor users with a certain degree of privacy protection during the day time without affecting the indoor users to view the outdoor scenery. In addition, the multifunctional multilayer composite sheet materials are more effective in blocking harmful ultraviolet rays and avoiding the damage caused by ultraviolet rays to the human body. Therefore, with the increasing awareness of environmental protection, the use of multifunctional multilayer composite sheet materials with functions such as heat insulation and UV protection is becoming more and more popular, and is particularly suitable for use in commercial buildings or houses with large windows or floor-to-ceiling glass. More generally, the multifunctional multilayer composite sheet materials can be produced into a heat-insulating film with adhesive glue, and the heat-insulating film is directly attached onto the glass window when used.

Vertical curtain assemblies on the market are typically designed with chemical fiber cloth, Vinyl sheet, metal sheet or wood sheet. The mounting step includes providing curtain laminas in a suitable size, a top retaining member for hanging the curtain laminas on the curtain rails and a counterweight portion for securing the curtain laminas. In the prior art, the top retaining member and the counterweight portion are usually a piece of hard film or metal sheet. The top retaining member and the counterweight portion are completely wrapped in the chemical fiber cloth curtain laminas, and fixed by hot pressing or stitching method when the chemical fiber cloth piece is installed. Vinyl sheet, metal sheet or wood sheet does not require a top retaining member and a counterweight portion, and it is only necessary to provide a through hole on the top of the Vinyl sheet, metal sheet or wood sheet to apply to the hook on the curtain rail.

New curtain assembly and installation methods that assist in advancing technological needs and industrial applications in curtain industry are desirable.

SUMMARY

One exemplary embodiment provides a curtain assembly. The assembly comprises curtain lamina made of a multifunctional multilayer composite sheet material, a top retaining member disposed on top of the curtain lamina and configured to receive the curtain lamina and to suspend the curtain lamina onto a curtain rail, and a counterweight portion disposed at a bottom of the curtain lamina and configured to receive the curtain lamina and stabilize the curtain lamina. The top retaining member comprises a first holding piece, a second holding piece, a top fastener, and a top fixing device. The connecting edges of the first holding piece and the second holding piece are pivotally connected by a top connecting device, thereby pivoting between an open position of the top retaining member and a closed position for gripping the top of the curtain lamina. The top fastener is configured to detachably lock the top retaining member in the closed position, and the top fixing device is configured to secure the curtain lamina within the top retaining member. The counterweight portion comprises a first vertical weight piece, a second vertical weight piece, a bottom fastener and a bottom fixing device. The connecting edges of the first vertical weight piece and the second vertical weight piece are pivotally connected by a bottom connecting device, thereby pivoting between an open position of the counterweight portion and a closed position for gripping the bottom of the curtain lamina. The bottom fastener is configured to detachably lock the counterweight portion in the closed position, and the bottom fixing device is configured to secure the curtain lamina within the counterweight portion.

Other exemplary embodiments are discussed herein. The concepts, the specific structure and the technical effects of the present invention will be further described in conjunction with the accompanying drawings in order to fully understand the objectives, features and effects of exemplary embodiments.

DETAILED DESCRIPTION OF EMBODIMENTS

Figure 1:
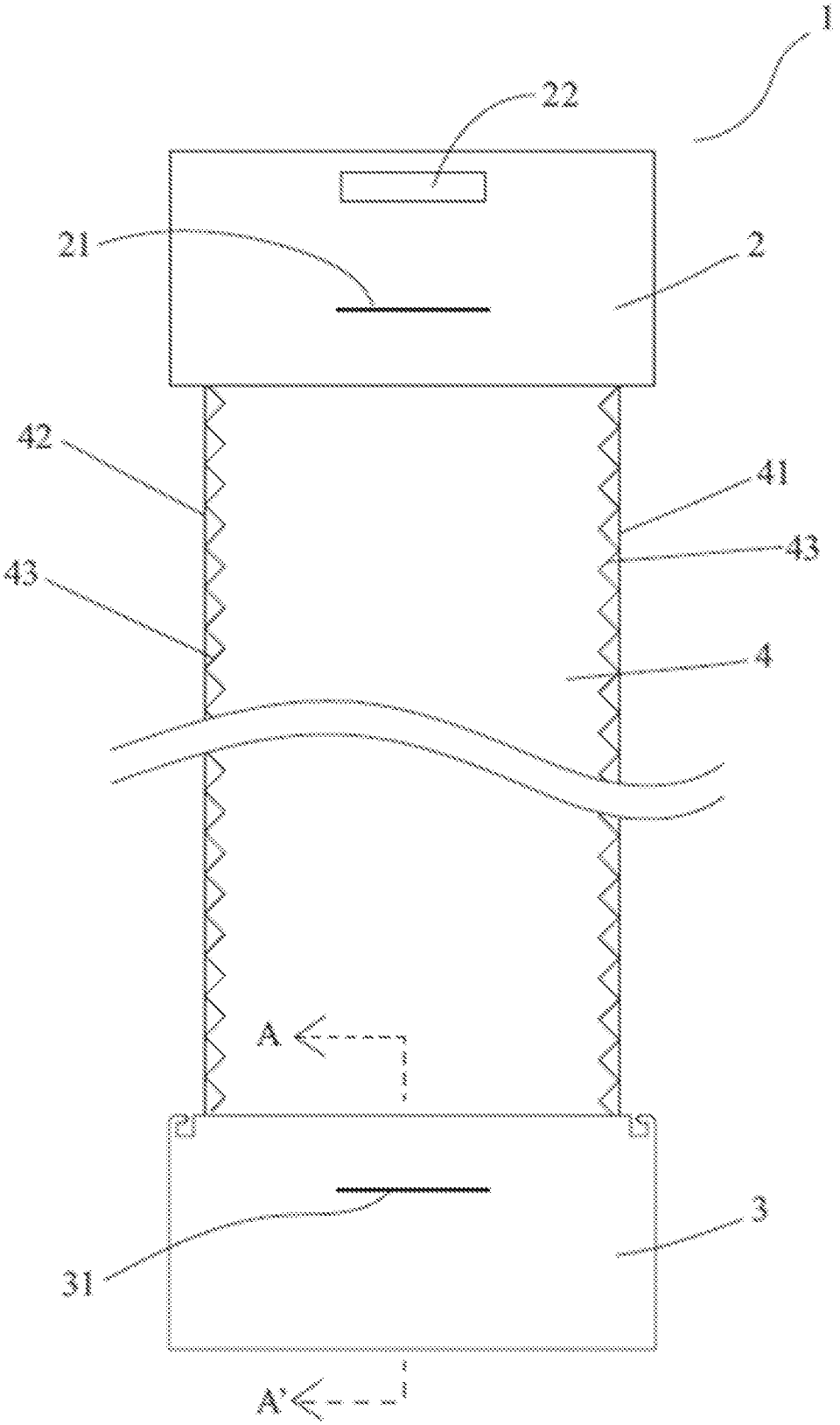
FIG. 1 is a front elevation view of a curtain assembly in accordance with an embodiment of the present invention.

Exemplary embodiments relate to curtain assembly and installation methods thereof with novel technical design and improved performance.

Many existing curtain assembly are not suitable for incorporating multifunctional multilayer composite sheet materials. Conventional configurations or methods, such as adhering a heat-insulating film made of multifunctional multilayer composite sheet materials directly onto a glass window, are undesirable and lack flexibility because the heat-insulating film is not allowed to be attached to or removed from the glass window at any time according to practical needs. Further, conventional installation methods are flawed in many aspects, such as cumbersome and time consuming, and requiring assistance from professionals to complete the installation task.

Exemplary embodiments solve one or more existing problems by providing novel curtain assembly design and installation methods with various technical advantages. For example, exemplary embodiments enable a multifunctional multilayer composite sheet material or materials to be desirably applied to curtain assembly. Exemplary curtain assembly, with incorporation of multifunctional multilayer composite sheet material or materials, is advantages in various aspects, such as having simple structure, environmentally friendly, and easy to be installed and maintained, etc. Without necessity of seeking help from professional experts, exemplary curtain assembly can be installed or assembled by an ordinary person. Exemplary curtain assembly, with various technical benefits, such as effectively preventing UV-light from entering buildings, can save energies and facilitate privacy protection without compromising appreciation of outside views for indoor humans.

In an exemplary embodiment, there is provided a curtain assembly. The assembly comprises a curtain lamina made of a multifunctional multilayer composite sheet material, a top retaining member disposed on top of the curtain lamina and configured to receive the curtain lamina and to suspend the curtain lamina onto a curtain rail, and a counterweight portion disposed at a bottom of the curtain lamina and configured to receive the curtain lamina and stabilize the curtain lamina. The top retaining member comprises a first holding piece, a second holding piece, a top fastener, and a top fixing device. The connecting edges of the first holding piece and the second holding piece are pivotally connected by a top connecting device, thereby pivoting between an open position of the top retaining member and a closed position for gripping the top of the curtain lamina. The top fastener is configured to detachably lock the top retaining member in the closed position, and the top fixing device is configured to secure the curtain lamina within the top retaining member. The counterweight portion comprises a first vertical weight piece, a second vertical weight piece, a bottom fastener and a bottom fixing device. The connecting edges of the first vertical weight piece and the second vertical weight piece are pivotally connected by a bottom connecting device, thereby pivoting between an open position of the counterweight portion and a closed position for gripping the bottom of the curtain lamina. The bottom fastener is configured to detachably lock the counterweight portion in the closed position, and the bottom fixing device is configured to secure the curtain lamina within the counterweight portion.

Additionally and alternatively, the top fastener and the bottom fastener are each designed as a snap fit or a convex and concave engagement means.

Additionally and alternatively, the top fastener designed as the convex and concave engagement device means comprises a convex portion disposed on the first holding piece, and a concave portion that corresponds to the convex portion and is disposed on the second holding piece. When the top retaining member is in the closed position, the convex portion is adaptively inserted into the concave portion and locks the top retaining member.

Additionally and alternatively, one or more convex portions are provided on two edges of a side of the first holding piece with the side being in contact with the second holding piece. The shape of the one or more convex portions is selected from a group consisting of a semi-dome shape, a circular shape, a square shape and an elongated shape. One or more concave portions are provided, at corresponding locations of one or more convex portions, on a side of the second holding piece with the side being in contact with the first holding piece. The shape of the one or more concave portions matches with the shape of the one or more convex portions.

Additionally and alternatively, the bottom fastener designed as the convex and concave engagement means comprises a convex portion disposed on the first vertical weight piece, and a concave portion that corresponds to the convex portion and is disposed on the second vertical weight piece. The convex portion is adaptively inserted into the concave portion and locks the counterweight portion when the counterweight portion is in the closed position.

Additionally and alternatively, one or more convex portions are provided on two edges of a side of the first vertical weight piece with the side being in contact with the second vertical weight piece. The shape of the one or more convex portions is selected from a group consisting of a semi-dome shape, a circular shape, a square shape, and an elongated shape. One or more concave portions are provided, at corresponding locations of one or more convex portions, on a side of the second vertical weight piece with the side being in contact with the first vertical weight piece. The shape of one or more concave portions matches the shape of the one or more convex portions.

Additionally and alternatively, the top fixing device comprises at least one opening respectively disposed on the first holding piece and the second holding piece, and a set of interlocking teeth disposed at the at least one opening and configured to secure the top of the curtain lamina.

Additionally and alternatively, the at least one opening is configured as a slit that is sized to allow a blade to pass just through the first holding piece and the second holding piece.

Additionally and alternatively, the bottom fixing device comprises at least one opening respectively disposed on the first vertical weight piece and the second vertical weight piece, and a set of interlocking teeth disposed at the at least one opening for securing the bottom of the curtain lamina.

Additionally and alternatively, the at least one opening is configured as a slit that is sized to allow a blade to pass just the first vertical weight piece and the second vertical weight piece.

Additionally and alternatively, the top retaining member comprises a means configured to receive a hook provided on the curtain rail.

Additionally and alternatively, the means configured to receive a hook provided on the curtain rail comprises a through hole disposed at a position of the top retaining member with the position being close to the top of the top retaining member.

Additionally and alternatively, the counterweight portion further comprises a hook disposed at both ends of the counterweight portion and configured to receive a chain or rope connecting adjacent curtain lamina.

Additionally and alternatively, each of the width of the counterweight portion and the width of the top retaining member is wider than the width of the curtain lamina.

Additionally and alternatively, the multifunctional multilayer composite sheet material comprises a smooth surface.

Additionally and alternatively, the multifunctional multilayer composite sheet material comprises two side edges that are sewed with wires and are covered.

Additionally and alternatively, the wires are sewed in a Z-interlaced manner to cover the two side edges.

Additionally and alternatively, the wires are nylon threads or other proper threads.

In another exemplary embodiment, there is provided a method of installing a curtain assembly. The method provides a curtain assembly. The curtain assembly comprises a curtain lamina made of a multifunctional multilayer composite sheet material, a top retaining member disposed on top of the curtain lamina and configured to receive the curtain lamina and to suspend the curtain lamina onto a curtain rail, and a counterweight portion disposed at a bottom of the curtain lamina and configured to receive the curtain lamina and stabilize the curtain lamina. The top retaining member comprises a first holding piece, a second holding piece, a top fastener, and a top fixing device. The connecting edges of the first holding piece and the second holding piece are pivotally connected by a top connecting device, thereby pivoting between an open position of the top retaining member and a closed position for gripping the top of the curtain lamina. The top fastener is configured to detachably lock the top retaining member in the closed position, and the top fixing device is configured to secure the curtain lamina within the top retaining member. The counterweight portion comprises a first vertical weight piece, a second vertical weight piece, a bottom fastener and a bottom fixing device. The connecting edges of the first vertical weight piece and the second vertical weight piece are pivotally connected by a bottom connecting device, thereby pivoting between an open position of the counterweight portion and a closed position for gripping the bottom of the curtain lamina. The bottom fastener is configured to detachably lock the counterweight portion in the closed position, and the bottom fixing device is configured to secure the curtain lamina within the counterweight portion. The method further comprises in an open position of the counterweight portion and the top retaining member, respectively placing the top of the curtain lamina into the top retaining member and placing the bottom of the curtain lamina into the counterweight portion; closing and locking the counterweight portion and the top retaining member; inserting, by a blade, into an opening of the fixing means provided to the counterweight portion and the top retaining member, and partially cutting the curtain lamina through the opening, thereby fixing the curtain lamina within the counterweight portion and the top retaining member; and suspending the curtain lamina onto the curtain rail by a through hole provided at the top of the top retaining member.

More specific embodiments of the present invention are further described in detail below with reference to the specific embodiments. A person skilled in the art can readily understand the construction, advantages and benefits of exemplary embodiments of the present invention.

The specific embodiments will be further described below in conjunction with the drawings.

FIG. 1 shows an embodiment of curtain assembly. The curtain assembly may be used, for example, for vertical curtains. The curtain assembly 1 includes a curtain lamina or laminas 4 made of a multifunctional multilayer composite sheet material or multifunctional multilayer composite sheet materials. The multifunctional multilayer composite sheet material in accordance with the exemplary embodiment can be made into a multilayer structure, for example, including a Polyethylene terephthalate (PET) polyester base layer, an ultraviolet absorber coating and a scratch-resistant coating. The functions, in addition to heat insulation and energy saving, may also include effectively blocking harmful ultraviolet (UV) rays, preventing scratching and providing a degree of privacy protection to the indoor users. A person skilled in the art will appreciate that the multifunctional multilayer composite sheet material suitable for use in the exemplary embodiment may also be other suitable multifunctional multilayer composite sheet materials.

The curtain assembly 1 further includes a top retaining member 2 disposed on top of the curtain lamina 4 and configured to receive the curtain lamina 4 and to suspend the curtain lamina 4 on a curtain rail, and a counterweight portion 3 disposed on the bottom of the curtain lamina 4 and configured to receive the curtain lamina 4 and to stabilize the curtain lamina 4. The top retaining member 2 further includes a means configured to receive a hook disposed on the curtain rail. As illustrated in FIG. 1, the means configured to receive a hook disposed on the curtain rail includes a through hole 22 provided on the top retaining member 2 at a position near the top. In addition to what the figure shows, the through hole 22 may be provided as a through hole that protrudes from the top of the top retaining member 2 and cooperates with the hooks on the curtain rail. The counterweight portion 3 is intended to stabilize the curtain lamina 4, and the term "stabilize" means keeping the curtain lamina 4 flat and vertical, reducing any swinging and/or winding of the curtain lamina 4. The counterweight portion 3 further includes a hook 35 disposed at both ends of the counterweight portion and configured to receive a chain or rope connecting to two adjacent curtain laminas, and a chain or rope connecting to the two adjacent curtain laminas for connecting the movement of each curtain lamina and keeping the distance between the curtain laminas.

Each of the top retaining member 2 and the counterweight portion 3 may be made of suitable materials, such as plastic, metal, or combination thereof. Further, each of the width of the counterweight portion 3 and the width of the top retaining member 2 may be wider than the width of the curtain lamina 4, and the top and the bottom of the curtain lamina 4 are wrapped in the top retaining member 2 and the counterweight portion 3, respectively. The length of the top retaining member 2 may be set to be the same as or longer than the length of the counterweight portion 3. In an embodiment, the length of the top retaining member 2 is shorter than the length of the counterweight portion 3.

As illustrated in FIGS. 2 to 5, the top retaining member 2 includes a first holding piece 26 and a second holding piece 27. The connecting edges of the first holding piece 26 and the second holding piece 27 are pivotally connected by a top connecting means. For example, the first holding piece 26 and the second holding piece 27 are pivotally connected by a hinge to pivotally move between an open position and a closed position of the top retaining member 2. In the open position of the top retaining member 2, the top of the curtain lamina 4 is allowed to be received, and in the closed position of the top retaining member 2, the top of the curtain lamina 4 is gripped by the top retaining member 2. The counterweight portion 3 includes a first vertical weight piece 36 and a second vertical weight piece 37. The connecting edges of the first vertical weight piece 36 and the second vertical weight piece 37 are pivotally connected by a bottom connecting device. For example, the first vertical weight 36 and the second vertical weight piece 37 are pivotally connected by a hinge to pivotally move between an open position and a closed position of the counterweight portion 3. In the open position of the counterweight portion 3, the bottom of the curtain lamina 4 is allowed to be received, and in the closed position of the counterweight portion 3, the bottom of the curtain lamina 4 is gripped by the top retaining member 2.

Figure 2:
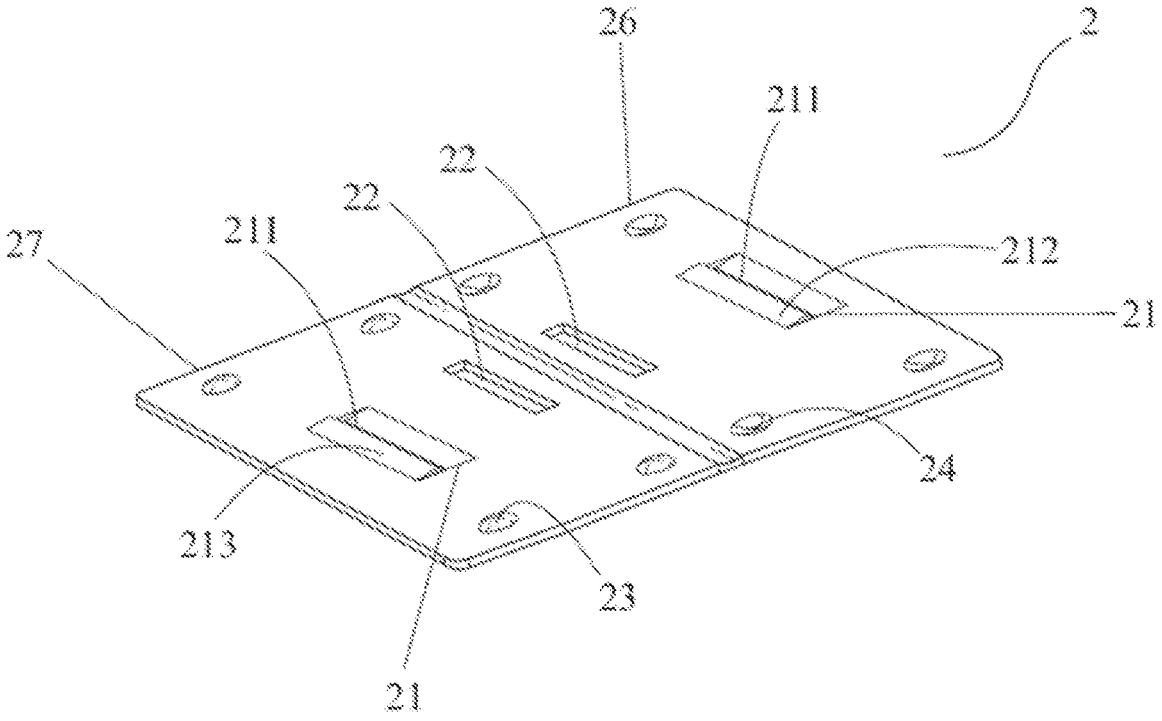
FIG. 2 is a plane development perspective view of a top retaining member in accordance with an embodiment of the present invention.

The top retaining member 2 also includes a fastener configured to detachably lock the top retaining member 2 when in the closed position of the top retaining member 2. As illustrated in FIG. 2, the fastener of the top retaining member 2 is designed as a convex and concave engagement means. The convex and concave engagement means includes a convex portion 23 provided to the first holding piece 26 and a concave portion 24, corresponding to the convex portion 23, provided to the second holding piece 27. When the top retaining member 2 is in the closed position, the convex portion 23 fits into the concave portion 24 and locks the top retaining member 2. In the present embodiment, a plurality of convex portions 23 are provided at two edges of the first holding piece 26 on the side in contact with the second holding piece 27, and a plurality of concave portions 24 are provided, at positions corresponding to the plurality of convex portions, on the side of the second holding piece 27 in contact with the first holding piece 26. As illustrated, the plurality of convex portions 23 are provided as a semi-domed shape, and the shape of the plurality of concave portions 24 matches with that of the plurality of convex portions 23. It can be understood that the shapes of the plurality of convex portions 23 and the plurality of concave portions 24 can also be set to other shapes such as a circular shape, a square shape or an elongated shape. It will be understood by a person skilled in the art that the structure of the fastener is not limited to the design of the embodiment. Instead, the structure of the fastener may be other forms suitable for detachably locking the top retaining member 2. For example, the top retaining member 2 can also be detachably locked by a buckle device such as a buckle or a screw connection or the like.

Figure 3:
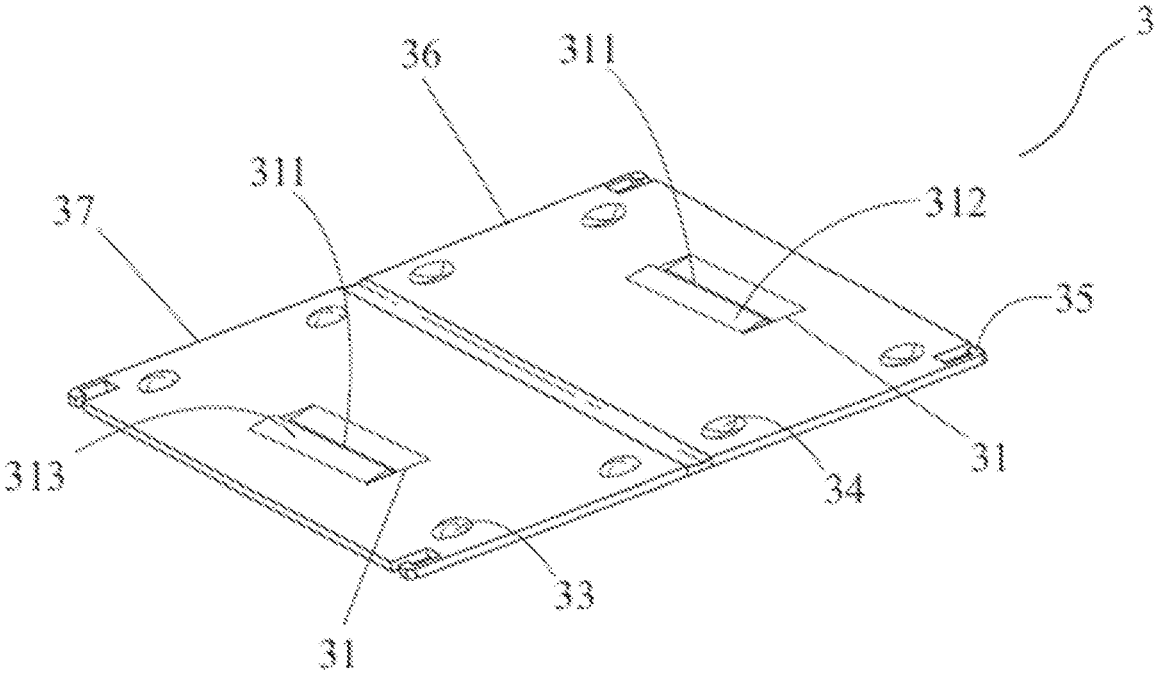
FIG. 3 is a plane development perspective view of a counterweight portion in accordance with an embodiment of the present invention.
Figure 4:
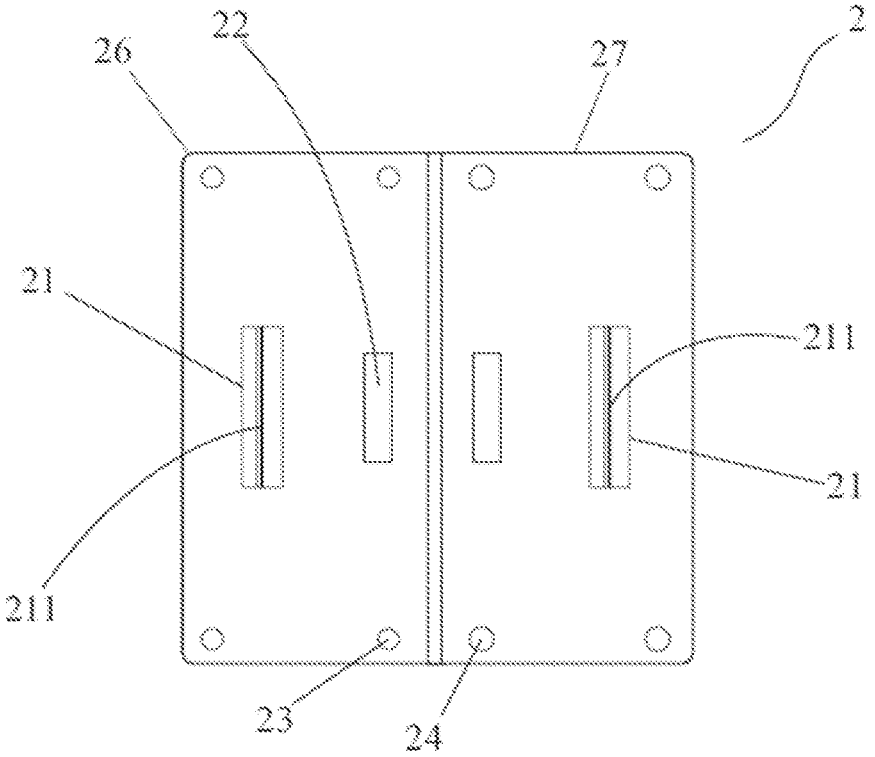
FIG. 4 is a plane development of the top retaining member of the embodiment of FIG. 2.
Figure 5:
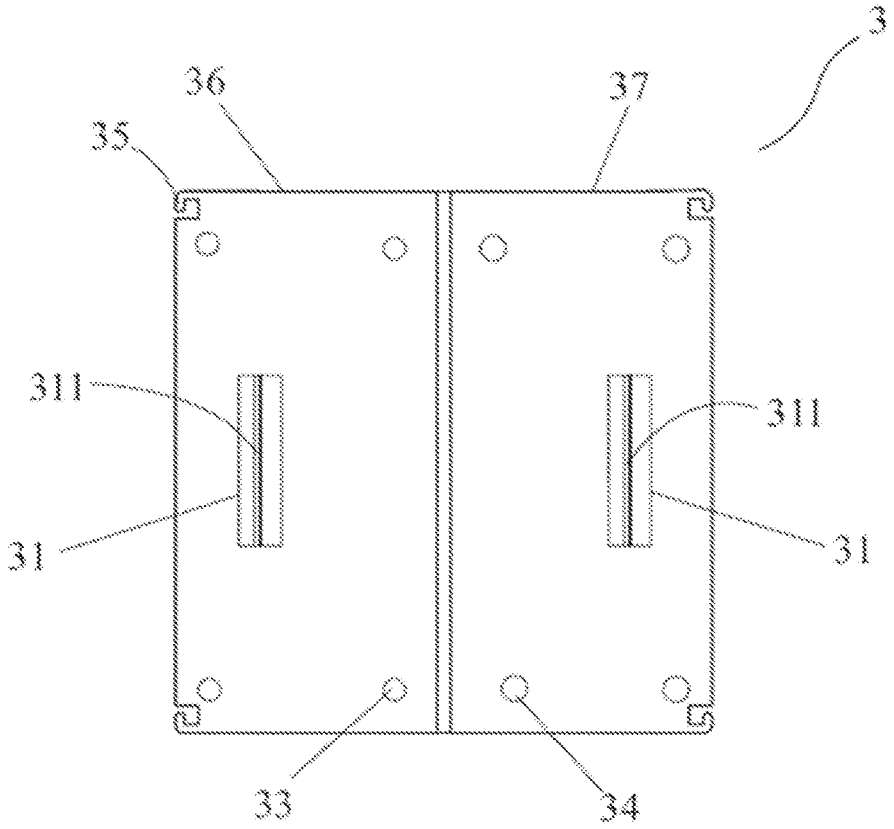
FIG. 5 is a plane development of the counterweight portion of the embodiment of FIG. 3.

Similar to the top retaining member 2, the counterweight portion 3 further includes a fastener configured to detachably lock the counterweight portion 3 in the closed position of the counterweight portion 3. It is illustrated in FIG. 3 that the fastener of the counterweight portion 3 are likewise designed as convex and concave engagement means. The convex and concave engagement means includes a convex portion 33 disposed on the first vertical weight piece 36 and a concave portion 34, corresponding to the convex portion 33, disposed on the second vertical weight piece 37. When the counterweight portion 3 is in the closed position, the convex portion 33 is adaptively inserted into the concave portion 34 and locks the counterweight portion 3. In the present embodiment, a plurality of convex portions 33 are provided at two edges of the first vertical weight piece 36 on the side in contact with the second vertical weight piece 37, and a plurality of concave portions 34 are provided, corresponding to the position of the plurality of convex portions, on the side of the second vertical weight piece 37 in contact with the first vertical weight piece 36. As illustrated, the plurality of convex portions 33 are also provided as a semi-domed shape, and the shape of the plurality of concave portions 34 matches with that of the plurality of convex portions 33. It can be understood that the shapes of the plurality of convex portions 33 and the plurality of concave portions 34 can also be set to other shapes such as a circular shape, a square shape or an elongated shape. Like the fastener of the top retaining member 2, the structure of the fastener of the counterweight portion 3 is not limited to the design of the present embodiment and it may be other forms suitable for detachably locking the counterweight portion 3. For example, the counterweight portion 3 can also be detachably locked by a buckle device such as a buckle or a screw connection or the like.

Furthermore, the counterweight portion 3 further includes a bottom fixing device 31 configured to secure a bottom of the window lamina 4 within the counterweight portion 3. As illustrated in FIG. 3, 6 or 7 or 7A, the bottom fixing device 31 includes an opening or openings 311 disposed on the first vertical weight piece 36 and the second vertical weight piece 37, and a set of interlocking teeth 312, 313 disposed at the openings for fixing the curtain lamina. In the present embodiment, the opening 311 is configured as a slit that is sized to allow a blade 5 to pass just through the first vertical weight piece 36 and the second vertical weight piece 37. The set of interlocking teeth 312, 313 includes two projections that are staggered up and down like a tooth or a gear. It will be appreciated that the counterweight portion 3 may include more than one opening and more than one set of interlocking teeth to enable the curtain lamina 4 to be more securely mounted or installed within the counterweight portion 3.

Likewise, the top retaining member 2 further includes a top fixing device 21 configured to secure the top 4 of the curtain lamina within the top retaining member 2. As illustrated in FIG. 2 and with reference to FIGS. 6 and 7, the top fixing device 21 includes an opening or openings 211 disposed on the first holding piece 26 and the second holding piece 27, and a set of interlocking teeth 212, 213 of the curtain lamina disposed at the opening and configured for fixing the window lamina. In the present embodiment, the opening 211 is provided as a slit which is sized to allow a blade 5 to pass just through the first holding piece 26 and the second holding piece 27. The set of interlocking teeth 212, 213 includes two projections that are staggered up and down like a tooth or a gear. Likewise, the top retaining member 2 can include more than one opening and more than one set of interlocking teeth to enable the curtain lamina 4 to be more securely mounted within the top retaining member 2.

According to some aspects of exemplary embodiments, there is provided with an assembly for holding a curtain made of sheet material. The assembly comprises at least one attachment device configured to attach to the top or bottom of the curtain. The attachment device comprises a first attachment part, a second attachment part, and fastening means configured to fasten the first and second attachment parts of the attachment device onto a part of the curtain, on opposite sides thereof respectively. The fastening means comprises aligned first and second apertures of the first and second attachment parts respectively, with complementary formations on each of opposite sides of the apertures for inter-engagement to deform and bodily engage with confronting edges of an opening cut through the part of the curtain in alignment with the apertures.

For example, the first attachment part may be implemented as the first vertical weight piece 36. The second attachment part may be implemented as the second vertical weight piece 37. The first and second attachment parts may be made as separate pieces or, preferably, integrally connected together as a one-piece structure with a fold line running therebetween, about which the two attachment parts are foldable closed for use as herein described.

Alternatively and optionally, the attachment device comprises a top attachment device configured to attach to the top of the curtain, or a bottom attachment device configured to attach to the bottom of the curtain, or both. The top attachment device may be implemented as the top retaining member 2. The bottom attachment device may be implemented as the counterweight portion 3.

Figure 6:
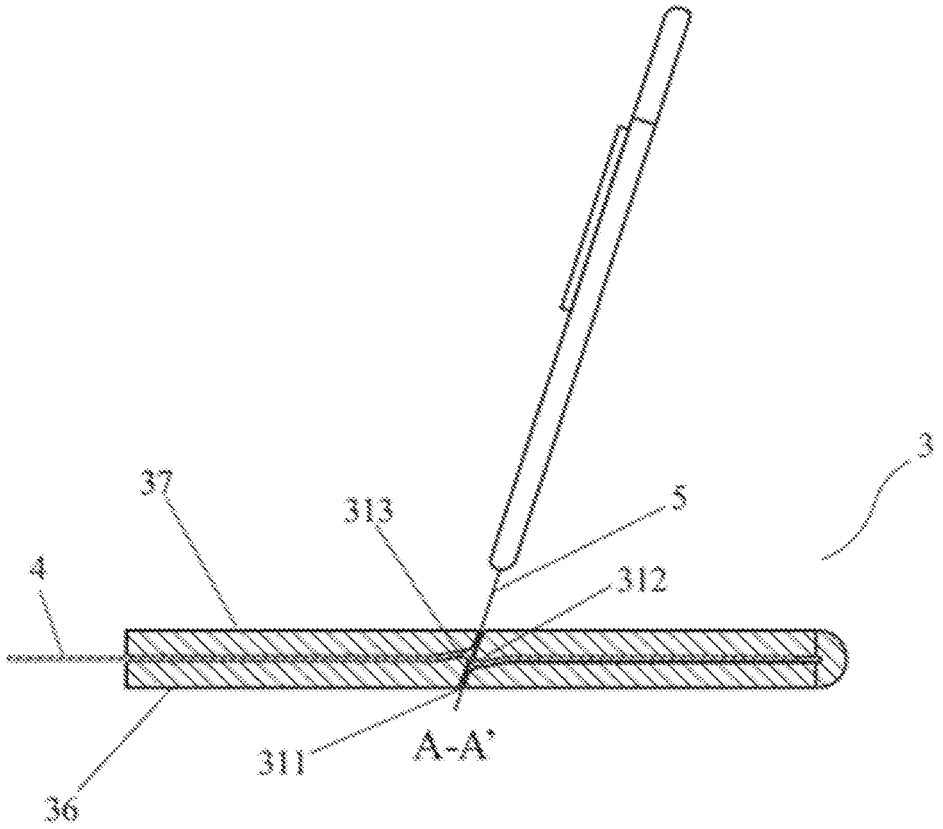
FIG. 6 is a cross-sectional view of the counterweight portion taken along line A-A of FIG. 1, with insertion of a cutting blade cutting through a sheet material of the curtain assembly.
Figure 7:
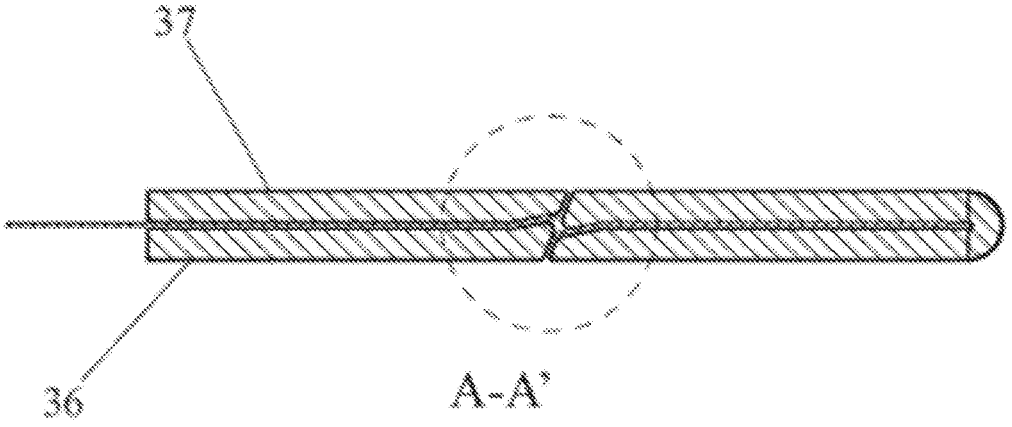
FIG. 7 is a cross-sectional view corresponding to FIG. 6, with the cutting blade removed and showing the sheet material cut through to form an opening.
Figure 7A:
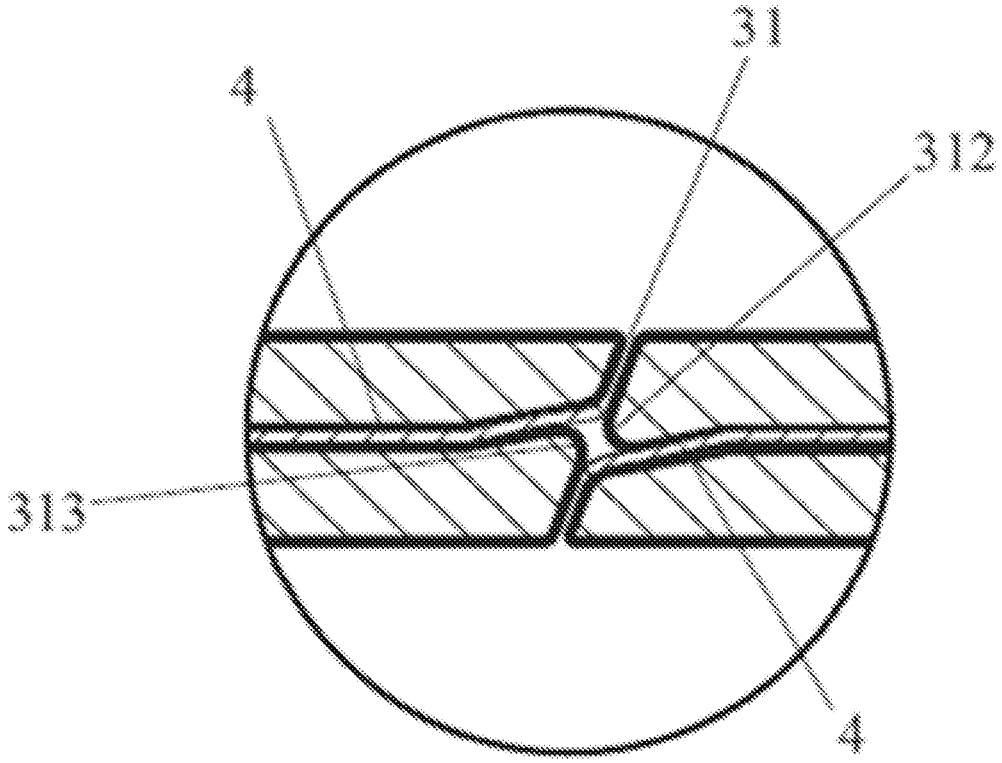
FIG. 7A is a part of FIG. 7, on an enlarged scale, which shows opposite sides of the opening being deformed by interlocking teeth, resulting in bodily inter-engagement between the counterweight portion and the sheeting material.

The fastening means (e.g., the top fixing device 21 or the bottom fixing device 31 as stated above), also as illustrated in FIGS. 6 and 7 and 7A, comprises a first apertures (e.g., the upper aperture as illustrated in FIG. 7A) of the first attachment part and a second apertures (e.g., the lower aperture as illustrated in FIG. 7A) of the second attachment part. The first and second apertures are aligned with each other. When a curtain sandwiched between the first attachment part and the second attachment part is cut though by a cutter (such as a blade) passing through the apertures to from an opening (e.g., a slit) on the curtain, complementary formations on each of opposite sides of the apertures exert effects or force on confronting edges of the opening. For example, the complementary formations enable inter-engagement to deform and bodily engage with confronting edges of the opening (FIG. 7A), thereby holding the curtain firmly in a desirable state. By way of example, the first and second apertures are slits. Other shapes, such as rectangular, round, etc. may be used according to practical needs.

To install curtain assembly in accordance with exemplary embodiments, the top retaining member 2 or the counterweight portion 3 is first opened to be in an open position. After the top and bottom of the curtain lamina 4 are placed in the top retaining piece 2 or the counterweight portion 3 respectively, the user can close the top retaining member 2 and the counterweight portion 3 and apply pressure respectively at the position of the top fastener and the bottom fastener, so that the plurality of convex portions 23 of the top fastener and the plurality of convex portions 33 of the bottom fastener are inserted into the respective plurality of concave portions 24, 34, thereby locking the top retaining member 2 and the counterweight portion 3. After closing and locking the top retaining member 2 and the counterweight portion 3, the user can insert into the top retaining member 2 or the counterweight portion 3 from the openings 211, 311 with the blade 5 or other suitable cutters, and partially cut the curtain lamina 4. After the curtain lamina 4 are partially cut, the interlocking teeth 212, 213, 312, 313 at the openings 211, 311 and the cut portion of the curtain lamina 4 press both ends of the cut portion of the curtain lamina 4 upward and downward respectively (as illustrated in FIG. 7), causing the both ends of the cut portion of the curtain lamina 4 to be engaged with each other, thereby preventing the curtain lamina 4 from being displaced, removed or dropped out of the top retaining member 2 or the counterweight portion 3. After the top retaining member 2 and the counterweight portion 3 are respectively installed on the top and bottom of the curtain lamina 4, the user can suspend the curtain lamina onto the curtain rail through a through hole provided at the top of the top retaining member.

It can be seen that the structure of the top retaining member 2 and the counterweight portion 3 in accordance with exemplary embodiments is very simple, easy to assemble, and overcome disadvantages of the cumbersome assembly procedures of prior art. Users can easily install the curtain assembly without any need of any specialized tools and equipment. Further, the top retaining member 2 and the counterweight portion 3 of exemplary embodiments can be easily removed and reused, meeting the requirements of self-service and environmental protection.

On the other hand, existing curtains using multifunctional multilayer composite sheet materials are usually set as roller blinds. When users want to close the curtains, they need to roll up the multilayer composite sheet materials, which readily leads to the folding of multifunctional multilayer composite sheet materials. In order to prevent the folding of composite sheet materials, it is common practice to emboss patterns on the multifunctional multilayer composite sheet materials, but the embossed pattern greatly compromises the clarity of the outdoor landscape. In the curtain assembly in accordance with one embodiment of the present invention, the multifunctional multilayer composite sheet material having a smooth surface without pattern can be utilized, which overcomes the prior art shortcomings of negatively affecting clarity of outdoor landscape.

According to still another embodiment of the present invention, both sides of a multifunctional multilayer composite sheet material may be sewn along the edges (41, 42) by wires 43 such as nylon threads or the like to cover the side edges (41, 42) of the multifunctional multilayer composite sheet material, thereby reducing the risk of the user being cut by the edges of the multifunctional multilayer composite material. As illustrated in FIG. 1, the threads are sewn in a Z-interlaced manner to cover both side edges of the curtain lamina 4. In addition, a person skilled in the art will appreciate that other types of threads, such as various natural fiber strands or chemical fiber strands, may be used in addition to nylon threads. The manner of interlacing is not limited to the Z-interlaced manner, and instead, it may be any other interlacing manners capable of covering the side edges of the curtain lamina 4.

Exemplary embodiments of the present invention have been described with reference to the accompanying drawings. However, the embodiments as described with reference to these accompanying drawings are intended to be illustrative of the embodiments and should not be considered to be limiting.

While some embodiments of the present general inventive concept have been illustrated and described, it will be understood by a person skilled in the art that the exemplary embodiments may be modified without departing from the principles and spirit of the present general inventive concept. The protection scopes to be sought in accordance with exemplary embodiments are to be defined by the claims and equivalents thereof

What is claimed is:

1. A curtain assembly comprising:

a curtain formed of composite sheet material, the curtain extending longitudinally from a first curtain edge to an opposing second curtain edge;

a slit in the curtain proximate one of the first and second curtain edges, the slit elongated substantially transversely and having opposing opening edges;

a pair of holding pieces connected by a pivot for relative rotation, the one of the first and second curtain edges held between the holding pieces;

complementary engagement means that are integral with the holding pieces and mutually engaged to fasten the holding pieces together;

an inner face on each holding piece, the inner face being substantially planar and abutting a side of the curtain;

a slot that extends through each holding piece and is elongated substantially transversely relative to the curtain;

a tooth on each holding piece that projects inwardly of its respective inner face and is elongated to extend alongside the slot; and a recess in each inner face that receives the tooth of the opposing holding piece, wherein the slots extend into the recesses, and the opening edges are received in the recesses and separated such that each opening edge abuts a respective tooth.

2. The curtain assembly of claim 1 wherein the slots and the slit are aligned and have substantially the same transverse extent.

3. The curtain assembly of claim 2 wherein the slots and the slit are disposed generally centrally in a transverse direction.

4. The curtain assembly of claim 1 wherein the slots are in substantial coplanar alignment with one another, the inner faces are substantially parallel and the slots are inclined relative to the inner faces.

5. The curtain assembly of claim 1 wherein the pair of holding pieces and the pivot are integrally formed.

6. The curtain assembly of claim 1 wherein the pair of holding pieces comprises a first pair of holding pieces fixed to the first edge and by which the curtain is suspended, and a second pair of holding pieces fixed to the second edge and comprising a counterweight.

7. A method of manufacturing the curtain assembly of claim 1, comprising:

pivoting at least one of the holding pieces to close the one of the first and second curtain edges between the pair of holding pieces; and passing a blade through one of the slots and through the one of the first and second curtain edges to thereby cut the slit and form the opposing opening edges.

8. An apparatus for holding an upper or lower curtain edge of a suspended curtain, the apparatus comprising:

a pair of holding pieces connected by a pivot for relative rotation between an open position for receiving the curtain edge and a closed position for holding the curtain edge therebetween;

complementary engagement means that are integral with the holding pieces and mutually engaged to fasten the holding pieces together;

an inner face on each holding piece, wherein the inner face is substantially planar;

a slot that extends through each holding piece and is adapted to receive a blade;

a tooth on each holding piece that projects inwardly of its respective inner face and is elongated to extend alongside the slot, each tooth having an inclined face that extends from the inner face to a tip of the tooth; and a recess in each inner face that the slot extends into, wherein, in the closed position, the recess receives the tooth of the opposing holding piece, the slots are aligned with one another, the tips of the teeth are spaced apart, and an imaginary plane coplanar with each inclined face intersects an opposing one of the teeth.

9. The apparatus of claim 8 wherein, in the closed position, the slots are in substantial coplanar alignment with one another and are inclined relative to the inner faces.

10. The apparatus of claim 8 wherein the pair of holding pieces and the pivot are integrally formed.

11. The apparatus of claim 8 wherein the slots are substantially parallel to the pivot.

12. The apparatus of claim 8 wherein each holding piece comprises a through hole, the through holes being in registration with one another in the closed position for receiving a curtain rail, the assembly being thereby adapted for suspending the curtain.

13. The apparatus of claim 8 comprising a counterweight adapted for suspension from a lower edge of the curtain.

* * * * *